United States Patent [19]

Pisio et al.

[11] 4,020,901

[45] May 3, 1977

[54] ARRANGEMENT FOR RECOVERING VISCOUS PETROLEUM FROM THICK TAR SAND

[75] Inventors: Peter Pisio; Charles F. Kirkvold, both of Calgary, Canada

[73] Assignee: Chevron Research Company, San Francisco, Calif.

[22] Filed: Jan. 19, 1976

[21] Appl. No.: 650,571

[52] U.S. Cl. ..... 166/50; 166/52; 166/57; 166/245; 166/272; 166/302

[51] Int. Cl.[2] ..... E21B 43/24

[58] Field of Search ..... 166/303, 302, 272, 271, 166/256, 252, 50, 57, 67, 74

[56] References Cited

UNITED STATES PATENTS

| | | | |
|---|---|---|---|
| 1,520,737 | 12/1924 | Wright | 166/265 |
| 1,816,260 | 7/1931 | Lee | 166/303 |
| 3,024,013 | 3/1962 | Rogers et al. | 166/256 |
| 3,129,758 | 4/1964 | Closmann | 166/272 X |
| 3,285,335 | 11/1966 | Reistle, Jr. | 166/252 |
| 3,338,306 | 8/1967 | Cook | 166/302 |
| 3,362,751 | 1/1968 | Tinlin | 166/302 X |
| 3,847,219 | 11/1974 | Wang et al. | 166/272 X |
| 3,954,140 | 5/1976 | Hendrick | 166/272 |

*Primary Examiner*—Stephen J. Novosad
*Attorney, Agent, or Firm*—Edward J. Keeling; R. L. Freeland, Jr.

[57] ABSTRACT

An arrangement is provided for recovering viscous oil from a tar sand formation having a large vertical dimension including a substantially vertical lined shaft extending through the tar sand formation. A first opening is formed in the lower portion of the shaft lining and at least one lateral hole extends into the formation through the first lateral hole. A plurality of tubular members are positioned in the lateral hole to provide both a closed loop flow path for fluid flow from the shaft into and out of the hole out of contact with the formation and a separate flow path for production fluids from the hole into the shaft. A steam source is connected to the tubular members forming the closed loop flow path. A second opening is formed in the shaft lining and a steam injection conduit extends through the second opening into the formation. The steam injection conduit is connected to the steam source for injecting steam into the formation.

4 Claims, 11 Drawing Figures

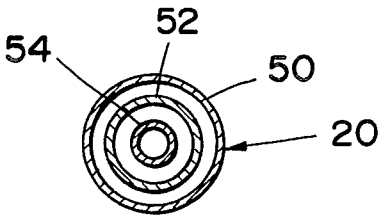
FIG_4
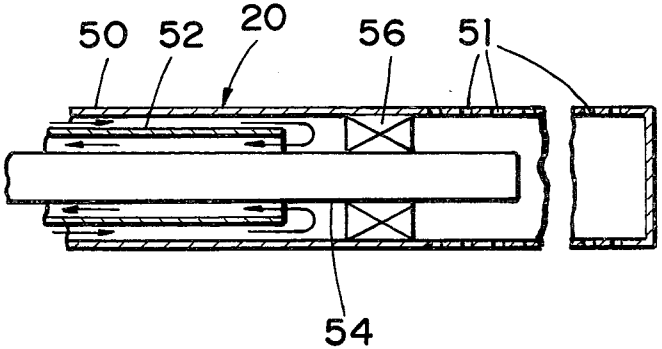
FIG_3
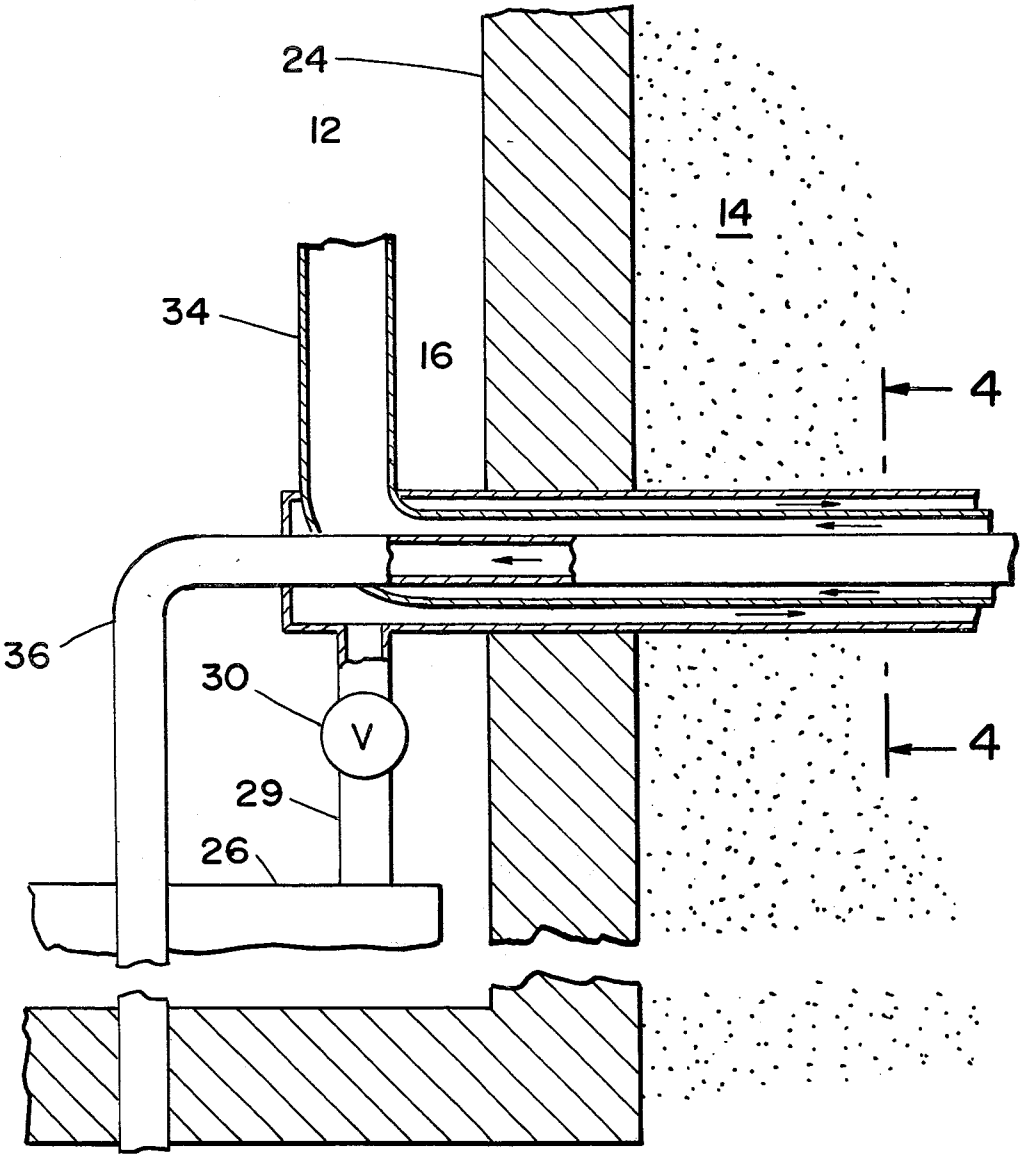

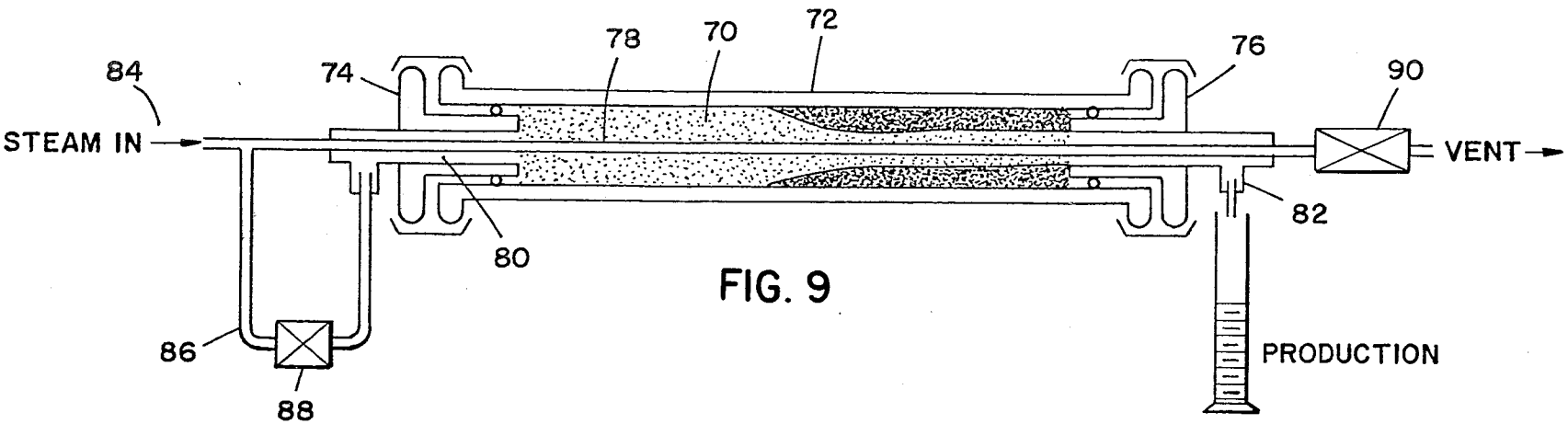
FIG. 9
RESIDUAL PETROLEUM WT %
| CORE POSITION | | PLANE A | B | C | D | E | F |
|---|---|---|---|---|---|---|---|
| LEFT SIDE | 1 | 3.8 | 5.5 | 5.9 | 6.5 | 8.2 | 7.2 |
| | 2 | 3.7 | 4.4 | 5.4 | 4.3 | 7.3 | 5.7 |
| | 3 | 3.9 | 4.2 | 5.2 | 5.7 | 4.6 | 7.9 |
| CENTER LINE | 4 | 3.7 | 4.4 | 5.2 | 4.9 | 8.8 | 9.0 |
| | 5 | 3.7 | 4.8 | 3.7 | 4.3 | 7.3 | 7.1 |
| | 6 | 3.7 | 3.9 | 4.1 | 4.2 | 6.7 | 5.4 |
| | 7 | 3.8 | 4.7 | 4.0 | 5.0 | 4.5 | 4.9 |
| RIGHT SIDE | 8 | 4.2 | 5.2 | 6.0 | 6.4 | 10.9 | 9.5 |
| | 9 | 3.8 | 4.4 | 5.8 | 4.5 | 7.0 | 7.3 |
| | 10 | 3.9 | 4.2 | 5.8 | 4.3 | 6.0 | 6.2 |
| | 11 | 4.1 | 5.1 | 7.1 | 5.4 | 5.2 | 5.8 |
FIG. 11
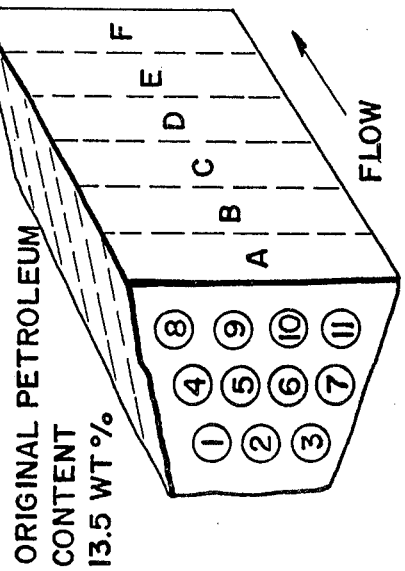
FIG. 10

ARRANGEMENT FOR RECOVERING VISCOUS PETROLEUM FROM THICK TAR SAND

CROSS REFERENCE TO RELATED APPLICATIONS

This application is related to application Ser. No. 627,304, filed Oct. 30, 1975, for "Method of Recovering Viscous Petroleum from an Underground Formation"; application Ser. No. 627,305, filed Oct. 30, 1975, for "Method of Recovering Viscous Petroleum from Tar Sand"; application Ser. No. 627,306, filed Oct. 30, 1975, for "Recovering Viscous Petroleum from Thick Tar Sand"; application Ser. No. 643,579, filed Dec. 22, 1975, for "System for Recovering Viscous Petroleum from Thick Tar Sand"; and application Ser. No. 643,580, filed Dec. 22, 1975, for "Method of Recovering Viscous Petroleum from Thick Tar Sand".

BACKGROUND OF THE INVENTION

This invention relates generally to recovering viscous petroleum from petroleum-containing formations. Throughout the world there are several major deposits of high-viscosity crude petroleum in oil sands not recoverable in their natural state through a well by ordinary production methods. In the United States, the major concentration of such deposits is in Utah, where approximately 26 billion barrels of in-place heavy oil or tar exists. In California, the estimate of in-place heavy oil or viscous crude is 220 million barrels. By far the largest deposits in the world are in the Province of Alberta, Canada, and represent a total in-place resource of almost 1000 billion barrels. The depths range from surface outcroppings to about 2000'.

To date, none of these deposits has been produced commercially by an in-situ technology. Only one commercial mining operation exists, and that is in a shallow Athabasca deposit. A second mining project is about 20% completed at the present time. However, there have been many in-situ well-to-well pilots, all of which used some form of thermal recovery after establishing communication between injector and producer. Normally such communication has been established by introducing a pancake fracture. The displacing or drive mechanism has been steam and combustion, such as the project at Gregoire Lake or steam and chemicals such as the early work on Lease 13 of the Athabasca deposit. Another means of developing communication is that proposed for the Peace River project. It is expected to develop well-to-well communication by injecting steam over a period of several years into an acquifer underlying the tar sand deposit at a depth of around 1800'. Probably the most active in-situ pilot in the oil sands has been that at Cold Lake. This project uses the huff-and-puff single-well method of steam stimulation and has been producing about 4000 barrels of viscous petroleum per day for several years from about 50 wells. This is probably a semi-commercial process, but whether it is a paying proposition is unknown.

The most difficult problem in any in-situ well-to-well viscous petroleum project is establishing and maintaining communication between injector and producer. In shallow deposits, fracturing to the surface has occurred in a number of pilots so that satisfactory drive pressure could not be maintained. In many cases, problems arise from healing of the fracture when the viscous petroleum that had been mobilized through heat cooled as it moved toward the producer. The cool petroleum is essentially immobile, since its viscosity in the Athabasca deposits, for example, is on the order of 100,000 to 1,000,000 cp at reservoir temperature.

As noted, the major problem of the economic recovery from many formations has been establishing and maintaining communication between an injection position and a recovery position in the viscous oil-containing formation. This is primarily due to the character of the formations, where effective mobility of fluids may be extremely low, and in some cases, such as the Athabasca Tar Sands, virtually nil. Thus, the Athabasca Tar Sands, for example, are strip mined where the overburden is limited. In some tar sands, hydraulically fracturing has been used to establish communication between injectors and producers. This has not met with uniform success. A particularly difficult situation develops in the intermediate overburden depths, which cannot stand fracturing pressure.

Heretofore, many processes have been utilized in attempting to recover viscous petroleum from viscous oil formations of the Athabasca Tar Sands type. The application of heat to such viscous petroleum formations by steam or underground combustion has been attempted. The use of slotted liners positioned in the viscous oil formation as a conduit for hot fluids has also been suggested. However, these methods have not been overly successful because of the difficulty of establishing and maintaining communication between the injector and the producer. Clearly, if one could establish and maintain communication between injector and producer, regardless of the drive fluid or recovery technique employed, it would open up many of these viscous petroleum deposits to a number of potentially successful projects.

BRIEF DESCRIPTION OF THE INVENTION

The present invention is directed to assisting the recovery of viscous petroleum from a petroleum-containing formation and is particularly useful in those formations where communication between an injection position and a recovery position is difficult to establish and maintain. The present invention of assisting the recovery of viscous petroleum from a petroleum-containing formation is particularly useful in a formation having a large vertical dimension. In one aspect an arrangement is provided for recovering viscous oil from a tar sand formation having a large vertical dimension including a substantially vertical lined shaft extending through the tar sand formation. A first opening is formed in the lower portion of the shaft lining and at least one lateral hole extends into the formation through the first lateral hole. A plurality of tubular members are positioned in the lateral hole to provide both a closed loop flow path for fluid flow from the shaft into and out of the hole out of contact with the formation and a separate flow path for production fluids from the hole into the shaft. A steam source is connected to the tubular members forming the closed loop flow path. A second opening is formed in the shaft lining and a steam injection conduit extends through the second opening into the formation. The steam injection conduit is connected to the steam source for injecting steam into the formation. A hot fluid, such as steam, is circulated through the closed-loop flow path to heat the viscous petroleum in the formation adjacent at least a portion of the lateral hole to form a potential passageway for fluid flow through the formation. A drive fluid, such as steam, is injected through the steam injection conduit into the formation to promote flow of petroleum to the flow path for production fluids. In preferred form, the hot fluid which is flowed through the flow path is steam, and the drive fluid used to promote movement of the petroleum is also steam. In some situations, other fluids such as gas or water may be useful drive fluids. Depending on certain conditions, the hot fluid and the drive fluid are injected simultaneously. Under other conditions, the hot fluid and the drive fluid are injected intermittently or alternatively. The injectivity of the drive fluid into the formation is controlled to some extent by adjusting the flow of hot fluid through the flow path member. In this manner, the sweep efficiency of the drive fluid in the formation may be improved.

In a more particular aspect, the invention provides an arrangement for use in recovering petroleum from a viscous petroleum-containing formation having a large vertical dimension in which a substantially vertical large diameter shaft is formed through a viscous petroleum-containing formation. The wall of the shaft is lined with suitable material to isolate the interior of the shaft from the formation. At least one first opening is formed in the shaft lining near the lower portion of the formation. A lateral hole is extended from the shaft into the formation through the first opening in the shaft lining. A first tubular member is positioned from the shaft through the first opening in the shaft lining into the lateral hole. A second tubular member is extended from the shaft and positioned interiorly through a portion of the first tubular member. A third tubular member is extended from the shaft and positioned interiorly of the second tubular member. The end of the third tubular member extends beyond the end of the second tubular member. All of the tubular members are sized to permit fluid flow in the space between the inside of one and the outside of another. A pack-off means packs off the outer portion of the third tubular member with the inside of the first tubular member beyond the end of the second tubular member. A flow opening is provided in the first tubular member beyond the pack-off means providing communication between the interior of the first tubular member and the formation. An opening is formed in the third tubular member beyond the pack-off means permitting flow into the third tubular member from the interior of the first tubular member. A steam source is connected with the first tubular member for flowing steam in the space between the first tubular member and the second tubular member to the pack-off means and for returning condensate from the pack-off means through the space between the second tubular member and the third tubular member. Condensate return means are connected to the second tubular member for removing condensate from the second tubular member. A second opening is formed in the said shaft lining and a steam injection conduit is extended from the shaft out of the second opening and in substantially parallel relationship to the longitudinal centerline of the shaft for injecting steam into the formation. Conduit means connect the steam injection conduit to the source of steam. A production flow line is connected to the end of the third tubular member inside the shaft for moving petroleum to a production location.

OBJECT OF THE INVENTION

The principal object of the present invention is to maximize recovery of viscous petroleum from a tar sand having a large vertical dimension wherein communication between an injector position and a producer position is difficult to establish and maintain by utilizing a hot fluid in a physcially separated flow path through the formation to assist in establishing and maintaining communication for a drive fluid used to promote movement of the petroleum to the producer position. Further objects and advantages of the present invention will become apparent when the description is read in view of the accompanying drawings which are made a part of this specification.

BRIEF DESCRIPTION OF THE DRAWINGS

FIG. 3 is an enlarged view partially in section of a portion of the apparatus of FIG. 1;

FIG. 4 is a sectional view taken at line 4—4 of FIG. 3;

FIG. 9 is an elevation view partially in section and illustrates apparatus used in conducting demonstrations in accordance with the present invention;

FIG. 10 is a perspective view of a block of tar sand flooded in accordance with the present invention showing position of core samples taken after the flood; and FIG. 11 is a table illustrating the analysis of such cores.

DETAILED DESCRIPTION OF THE EMBODIMENTS OF THE INVENTION

Figure 2:
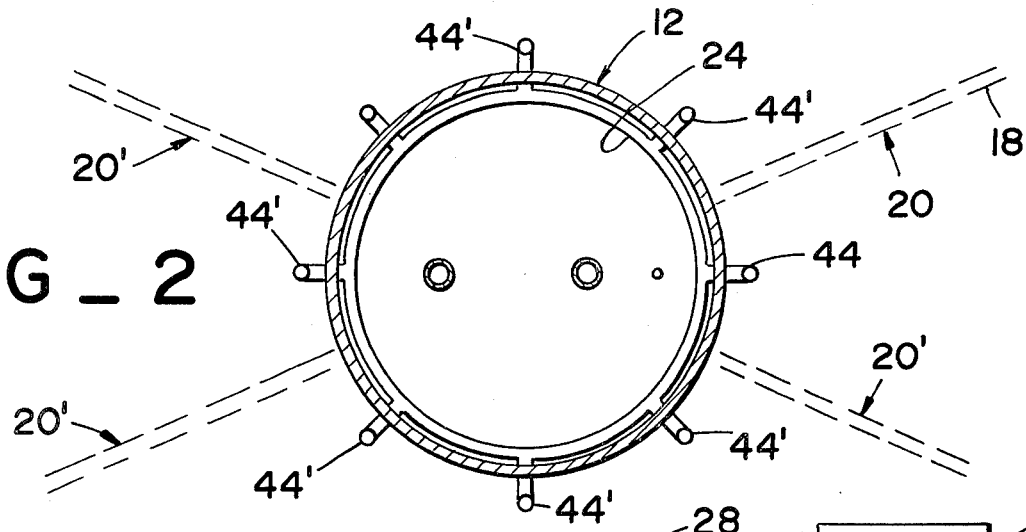
FIG. 2 is a sectional view taken at line 2—2 of FIG. 1.
Figure 1:
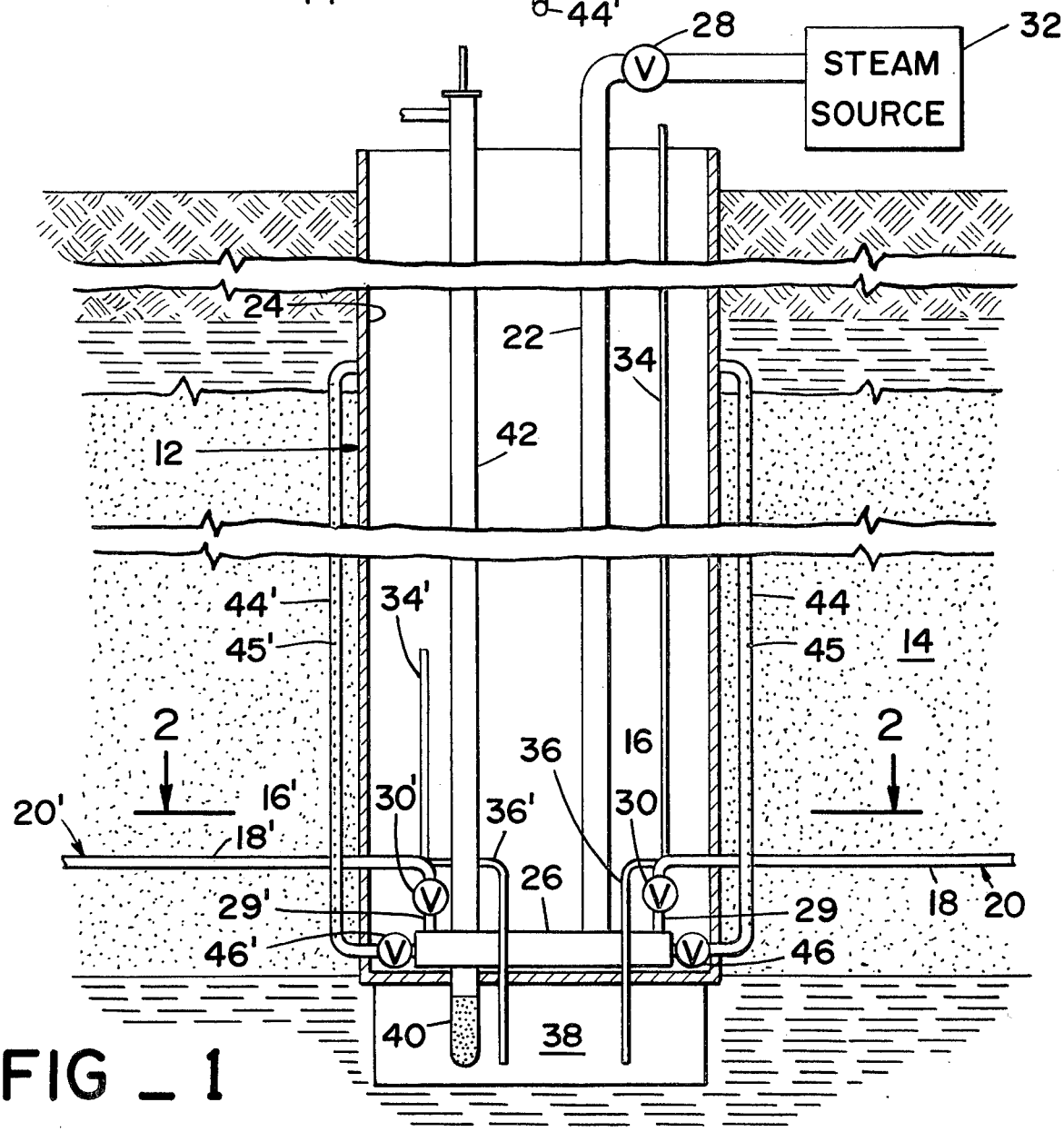
FIG. 1 is an elevation view partially in section and illustrates the preferred embodiment of apparatus assembled in accordance with the present invention for use in recovering viscous petroleum from an underground formation.

Refer now to the drawings, and to FIGS. 1 and 2 in particular, where the preferred embodiment of apparatus assembled in accordance with the invention is illustrated. FIG. 1 shows a substantially vertical shaft 12 formed through a petroleum-containing tar sand 14. The vertical passage may be excavated or drilled using conventionally known techniques. The shaft, generally indicated by the number 12, has been lined by suitable means such as casing 24. The lining may consist of steel or cement. The shaft lining separates the interior of the shaft from the formation. At least one first opening 16 is formed in the shaft lining near the lower portion of the formation 14. A lateral hole 18 extends from the shaft opening 16 into the formation. A plurality of tubular members indicated generally by the numeral 20 is positioned in the lateral hole. The tubular members, as discussed in detail below, provide a closed loop flow path for fluid flow from the shaft into and out of the hole and a separate flow path for production fluids from the hole into the shaft.

Thus, a source of hot fluid such as a steam source 32 is connected to the tubular members 20 by suitable conduits. A steam conduit 22 connects steam source 32 with a downhole steam header 26 through control valve 28. The header 26 is connected by riser pipe 29 to the tubular members 20 through a control valve 30. A condensate return conduit 34 is provided to return condensate to the surface from tubular members 20. A production flow line 36 provides a flow path for production fluids to production sump 38. Production fluids are moved to the surface by means of pump 40 and flow line 42. A steam injection conduit 44 having perforations 45 is also connected to steam header 26. Valve 46 controls flow of steam to steam injection conduit 44.

Steam is circulated through the closed loop flow path formed by the tubular members out of direct contact with the formation. In operation, it is usually desirable to first introduce steam into the steam injection conduit 44 to attempt to obtain injection of steam into formation 14 through perforations 45. In most instances, in viscous tar sands little or no injection is obtained. In accordance with the invention steam is then flowed through the closed-loop flow path formed by the tubular members to heat the viscous petroleum in tar sand formation 14 to reduce the viscosity of at least a portion of the petroleum adjacent the hole 18 occupied by the tubular members 20. This provides a potential passage for flow of the drive fluid or steam into the formation steam injection conduit perforations 45. By suitably controlling the flow in the closed loop flow path and the formation 14, a good sweep efficiency can be obtained and oil recovery maximized through the production flow path provided in the tubular members. Thus when the steam flowing in the flow path establishes injectivity for the drive fluid into the formation and results in some production of petroleum steam flow through the closed loop flow path is terminated to prevent breakthrough of the drive fluid. If injectivity of the drive fluid becomes undesirably low, then additional steam is flowed through the closed loop flow path to reestablish the desired injectivity.

FIG. 3 is an enlarged view of a portion of the apparatus shown in FIGS. 1 and 2. FIG. 4 is a sectional view taken at line 4—4 of FIG. 3. These figures illustrate in more detail the plurality of tubular members positioned in the lateral hole in accordance with the invention. As there shown a first tubular member 50 is extended through the hole 16 in the lower portion of the shaft lining 24. The tubular member extends out into the formation 14 and has a flow opening such as perforations 51 in its outer portion allowing communication between the interior of the tubular member 50 and the formation 14. A second tubular member 52 is positioned interiorly of the first tubular member 50 and extends through a portion of the first tubular member 50. The tubular members 50, 52 and 54 are sized to permit flow in the space between the outside of one and the inside of another. A third tubular member 54 extends from the shaft interiorly of the second tubular member 52 to a position beyond the end of the second tubular member. A pack-off means 56 packs off the space between the outside of the third tubular member 54 and the inside of the first tubular member 50 beyond the end of the second tubular member 52 and before the perforations 51.

Appropriate conduits connect the tubular members forming the closed loop flow path to the steam source. Thus, the first tubular member 50 is connected to steam header 26 by conduit 29 and valve 30. Conduit 34 is connected to the second tubular member 52 and provides a passage to the surface for condensate. Steam thus can be circulated in the closed loop flow path as indicated by the arrows in FIG. 3. Production fluids are produced through the third tubular member 54 and conduit 36 to the production sump.

Figure 5:
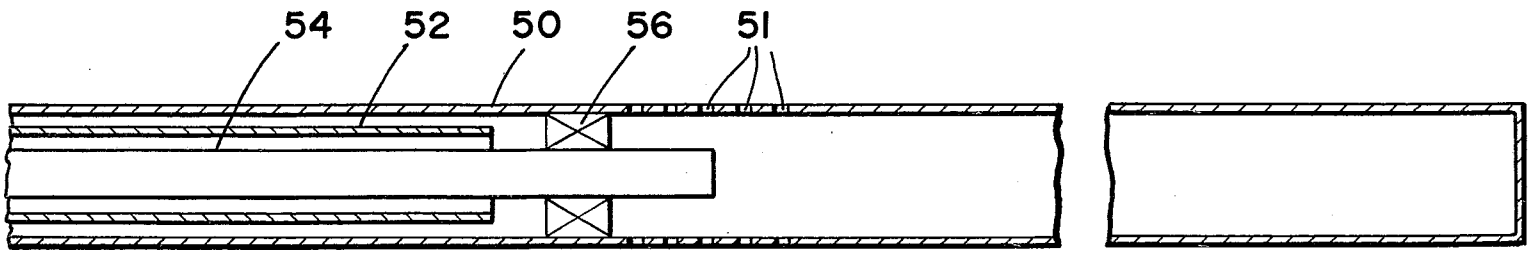
FIG. 5 is a sectional view illustrating a portion of the apparatus shown in FIG. 3.
Figure 6:
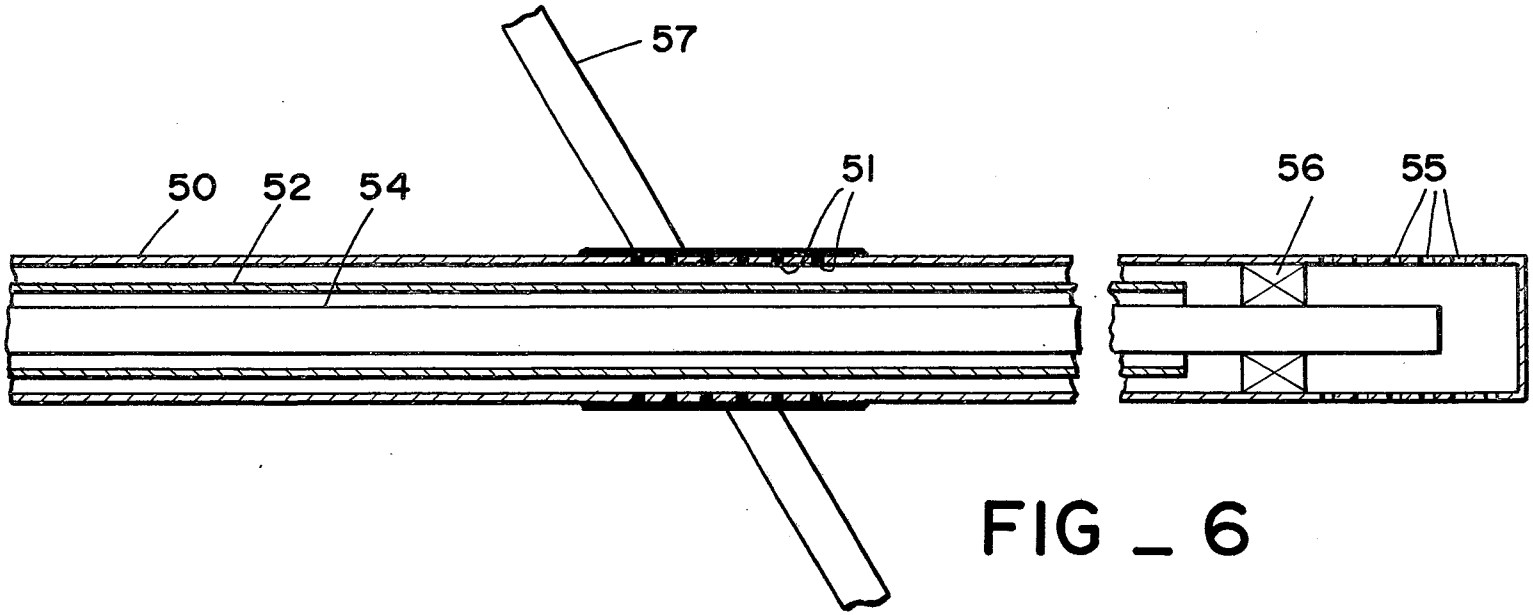
FIG. 6 is a sectional view illustrating an additional arrangement of the apparatus of FIG. 5.

FIGS. 5 and 6 illustrate a mode of operation of the present invention. FIG. 5 shows the set up of tubular members 50, 52 and 54 used to provide a closed loop flow path and a production flow path in accordance with the invention. After production of the formation fluids has declined through perforations 51 additional production may be obtained from a portion of the formation further away from the main shaft. As shown in FIG. 6, the lateral hole is extended further into the formation. This, of course, may occur when the hole is initially drilled or may be done later. It is usually preferred to set this up initially. The perforations 51 are plugged and the tubing members 52, 54 and the packing means are extended further out into the formation. New perforations 55 are formed and fluids from the new portion of the formation are produced. Auxiliary slant wells 57 are sometimes desirable as steam injection wells for this portion of the recovery operation.

Figure 7:
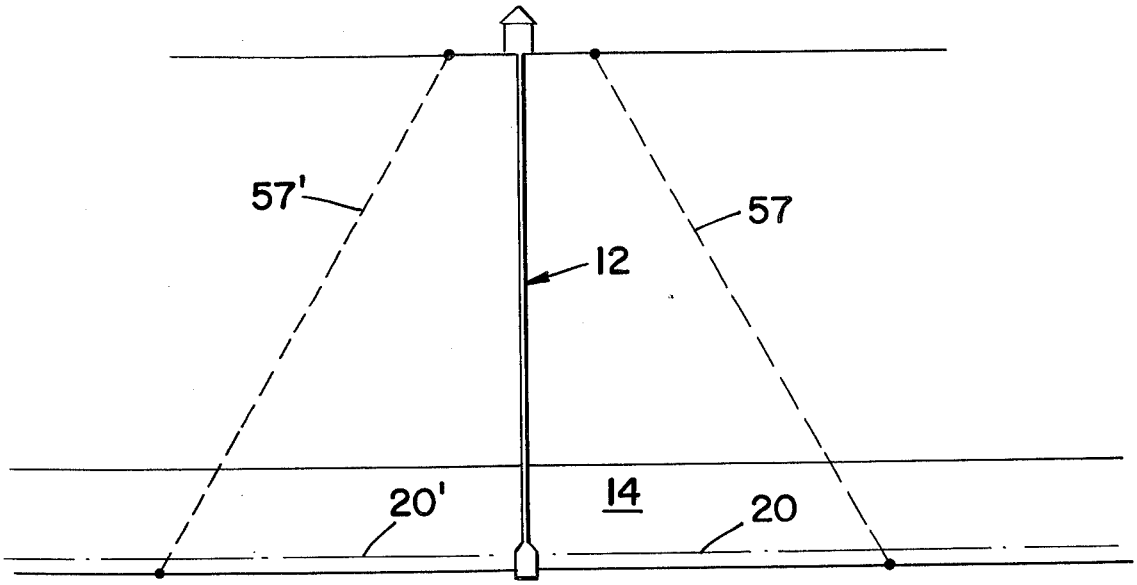
FIG. 7 is a schematic elevation view and illustrates a potential well layout in accordance with the present invention.
Figure 8:
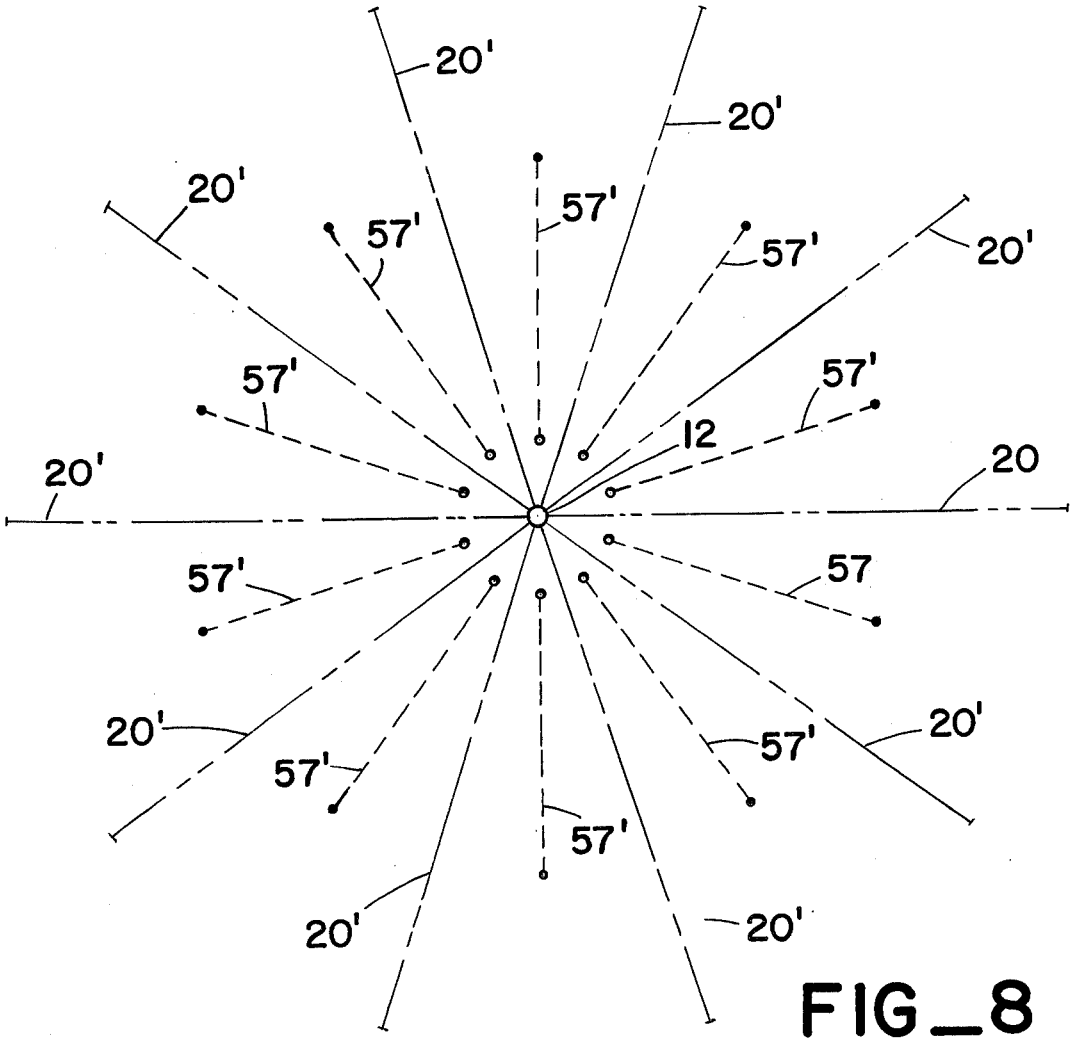
FIG. 8 is a schematic plan view of the layout of FIG. 6.

FIGS. 7 and 8 schematically illustrate a potential well layout in accordance with the invention. The main shaft 12 is utilized to develop a plurality of laterally extending holes containing tubular members 20, 20', etc., in the tar sand formation 14. Additionally, a plurality of auxiliary slant wells 57, 57', etc., may be utilized in the steam drive portion of the recovery cycle.

FIG. 9 is an elevation view partially in section and illustrates apparatus used in conducting demonstrations in accordance with the present invention. As there shown, a sand pack 70 of Athabasca tar sand was encased in a suitable elongated core tube 72. The core tube was provided with suitable end plates 74 and 76 for receiving a hollow tubular member 78. The apparatus is also arranged for steam injection into the face of the sand pack through conduit 80 and for collecting proceeds of the sand pack flood through conduit 82. A steam source 84 is connected to the tubular member 78 and to the sand pack face through tubing 86 and control valve 88. A down-stream control valve 90 controls flow of steam through the central tubular member 78. Thus, assisted recovery operations in accordance with the invention can be demonstrated utilizing the apparatus shown in FIG. 9.

FIG. 10 is a perspective of a block of Athabasca tar sand showing a number of core positions for cores taken longitudinally through the core block. The cores are identified by number and flow plane as indicated. The tar sand block was flooded in acordance with the method of the invention. The cores were taken after the flood and analyzed for residual petroleum. FIG. 11 is a table indicating the residual viscous petroleum weight by core position and plane of the cores of FIG. 6. The original block contained 13.5% by weight of viscous petroleum. As is evident from the table of FIG. 11, a substantial weight percent of a viscous petroleum was recovered when the block was flooded in accordance with the method of the present invention.

Further with respect to FIGS. 9, 10 and 11, in order to demonstrate the method of the present invention, it was necessary as a first step to set up an apparatus containing Athabasca oil sand having a zero effective permeability to steam. To do this, a 1 inch -ID by 12 inch-long quartz tube was used. The tube was packed with Athabasca oil sand containing about 13% weight viscous petroleum and about 4% water. Fittings were attached to both ends of the tube and a conventional steam drive applied to the oil sand at a pressure of 75 psi and a temperature of 320° F. It was found during the early runs that 50% of the petroleum was recovered because of unrealistic permeability to steam, and so the runs did not successfully simulate Athabasca conditions. It was found later that by using a ½inch-diameter solid steel rod, 12inches long, as a tool for ramming the oil sand very tightly in the tube, the room temperature air permeabilities were reduced to less than 50 millidarcies, a much more realistic value for viscous petroleum-containing formations. In this region of permeability, conventional steam drive did not work and the steam front advanced only about 1 inch into the tube and no farther, since the initially mobilized petroleum blocked off any communication, thereby reducing the effective mobility to zero. These conditions were reproducible on a satisfactory basis.

The method of the invention was then demonstrated using the apparatus shown schematically in FIG. 9. FIG. 9 shows a partially completed demonstration in accordance with the method of the invention. The in-place tubular member 78 has been heated by opening the heating annulus control valve 90 allowing steam to pass through. This immediately provides steam injectivity at the drive end of the tar sand pack 70 and viscous petroleum produced immediately at the producing end. Recoveries in these experiments ranged from 48 to 52% weight of the total petroleum in place. Residual petroleum was determined in every case by exhaustive solvent extraction at the end of each run. In some demonstrations, too much heat was allowed to pass through the tubular member 78, thereby creating an annulus outside the tubular member of very high mobility, allowing premature steam breakthrough and giving rather poorer recoveries, on the order of only 30% of the total petroleum in place.

In order to demonstrate the present method in a laboratory under more realistic field-type conditions, the demonstrations were modified by using large chunks of relatively undistributed Athabasca oil sand. These ranged in weight from one to about four kilograms and appeared to be devoid of cracks. They were randomly shaped and generally roundish or oval. These were encased in epoxy resin so that a total thickness of about 4 inches existed all around the oil sand piece. The placement of the in-place tubular member and injector and producer were very similar to the apparatus shown in FIG. 9. Again, a ⅛ inch stainless-steel tube was used for the in-place tubular member. In order to establish that there was indeed zero effective mobility, a steam drive was always applied to the injector before allowing any heat to pass through the in-place tubular member. These experiments were run, and in no case was there more than four drops of water produced at the exit from the block, and this slight water production ceased after less than one minute after initiating conventional steam drive. After reaching this static condition with zero injectivity, the heated annulus control valve 90 was cracked slightly, allowing passing of steam into the tubular member 78. Immediately petroleum flowed from the producer end of the core at a high petroleum/water ratio. Care must be exercised in controlling the amount of heat through the in-place tubular member since, in one case, this was not done and the over-all recovery was 30% of the total petroleum in place. Even continued flowing of steam through the block between injector and producer did not allow any further recovery of petroleum in this instance. On breaking open the block, it was found that a very clean oil sand of higher permeability had been created as an annulus close to the in-place pipe. Since the heat in the tubular member was not controlled, good sweep efficiency of the block was not obtained in this case.

The most successful demonstration run was that carried out on a 3.5-kg block of oil sand, initially 13.5% weight petroleum content. Total recovery was 65% of the petroleum originally in place. In all of these experiments, the same pressure and temperature of 75 psi and 320° F respectively were used.

Although, at first glance, the practice of the invention might lead one to expect a very low residual oil content close to the annulus surrounding the in-place tubular member and a high residual oil resulting from poor sweep efficiency in those regions of the sample farthest away from the in-place pipe, this was not the case. In fact, excellent sweep efficiency is obtained when the ratio of hot fluid to drive fluid is controlled so as not to permit early steam breakthrough. In order to evaluate this concern, the encased 3.5-kg block of oil sand at the end of a demonstration was cut through the center at right angles to the in-place tubular member. The oil sand was then cored using a ¾ inch-diameter core borer and sampled to a depth of ½inch . This was done at 11 locations in each of 6 different planes in the oil sand block. A diagram of the location of these core samples is shown in FIG. 10. A total of 66 samples was taken and each analyzed for residual petroleum content by exhaustive extraction with toluene. The results are shown in FIG. 11. It can be seen that a remarkably uniform sweep of the oil sand sample had taken place. Particularly surprising is the fact that the residual petroleum in those 6 cores taken from the annulus immediately surrounding the in-place tubular member show a residual petroleum content not too different from the cores farthest away from the in-place tubular member.

The demonstrations show that the method of the present invention satisfactorily simulated the zero effective mobility of the Athabasca oil sand deposit. The recovery demonstrations show that a communication path between injector and producer can be successfully developed; and provided excessive heating of the in-place tubular member is avoided, recoveries up to 65% of the petroleum in place can be achieved. The sweep efficiency is surprisingly high, resulting in an even distribution of residual oil. This means that the reservoir after an assisted-recovery operation conducted in accordance with the invention would be amendable to further recovery techniques such as combustion, chemical floods, etc. Particularly attractive is the fact that injecting drive fluids would be confined to the area of interest between injector and producer, since this would be the only pathway open to them. In other words, it is unlikely that the fluids would be lost to the other parts of the reservoir because of the relative impermeability of the formation on the outer edge of the swept area.

What is claimed is:

1. An arrangement for recovering viscous oil from a tar sand formation having a large vertical dimension comprising a substantially vertical shaft extending through a tar sand formation, a shaft lining on the wall of said shaft separating the interior of said shaft from said formation, a first opening in the lower portion of said shaft lining, at least one lateral hole extending into said formation through said first opening, a plurality of tubular members in said lateral hole to provide both a closed loop flow path for fluid flow from said shaft into and out of said hole and a separate flow path for production fluids from said hole into said shaft, a steam source, conduit means connecting said steam source to the tubular members forming said closed loop flow path, a second opening in said shaft lining, a steam injection conduit having an opening for injecting steam into said formation extending through said second opening in said shaft liner into said formation and conduit means connecting said steam source with said steam injection conduit.

2. The arrangement of claim 1 further characterized by auxiliary wells adapted for steam injection penetrating the formation adjacent said lateral hole.

3. An arrangement for use in recovering petroleum from a viscous petroleum-containing formation having a large vertical dimension comprising a substantially vertical large diameter shaft extending through a viscous petroleum-containing formation, a shaft lining on the wall of said shaft isolating the interior of said shaft from said formation, at least one first opening in said shaft lining near the lower portion of said formation, a lateral hole extending into said formation from said first opening in said shaft lining, a first tubular member extending from said shaft through said first opening in said shaft lining into said lateral hole, a second tubular member extending from said shaft and positioned interiorly through a portion of said first tubular member, a third tubular member extending from said shaft positioned interiorly of said second tubular member, the end of said third tubular member extending beyond the end of said second tubular member, all of the said tubular members being sized to permit fluid flow in the space between the inside of one and the outside of another, pack-off means packing off the outer portion of said third tubular member with the inside of said first tubular member beyond the end of said second tubular member, a flow opening in said first tubular member beyond said pack-off means providing communication between the interior of said first tubular member and said formation, an opening in said third tubular member beyond said pack-off means permitting flow into said third tubular member from the interior of said first tubular member, a steam source, conduit means connecting said steam source with said first tubular member for flowing steam in the space between said first tubular member and said second tubular member to said pack-off means and returning condensate from said pack-off means through the space between said second tubular member and said third tubular member, condensate return means connected to said second tubular member for removing condensate from said second tubular member, a second opening in said shaft lining, a steam injection conduit extending from said shaft out of said second opening and in substantially parallel relationship to the longitudinal centerline of said shaft for injecting steam into said formation, conduit means connecting said steam injection conduit to said source of steam and a production flow line connected to the end of said third tubular member inside said shaft for moving petroleum to a production location.

4. The arrangement of claim 3 further characterized by auxiliary wells adapted for steam injection penetrating the formation adjacent said lateral hole.

* * * * *